US006554903B1

(12) United States Patent
Sessa

(10) Patent No.: US 6,554,903 B1
(45) Date of Patent: Apr. 29, 2003

(54) UNITARY SPRAY NOZZLE

(75) Inventor: Eugene D. Sessa, Harrison Township, MI (US)

(73) Assignee: Nylok Corporation, Macomb, MI (US)

( * ) Notice: Subject to any disclaimer, the term of this patent is extended or adjusted under 35 U.S.C. 154(b) by 49 days.

(21) Appl. No.: 09/619,910

(22) Filed: Jul. 19, 2000

(51) Int. Cl.[7] ..... B05B 13/06

(52) U.S. Cl. ..... 118/317; 118/308; 118/306

(58) Field of Search ..... 118/317, 308, 118/318, 326, 306; 427/180, 181

(56) References Cited

U.S. PATENT DOCUMENTS

| | | | |
|---|---|---|---|
| 3,452,714 | A | 7/1969 | Burke et al. |
| 3,498,352 | A | 3/1970 | Duffy |
| 3,530,827 | A | 9/1970 | Burke |
| 3,554,258 | A | 1/1971 | Duffy |
| 3,579,684 | A | 5/1971 | Duffy |
| 3,731,724 | A | 5/1973 | Dorflinger |
| 3,766,584 | A | 10/1973 | Dorflinger |
| 3,787,222 | A | 1/1974 | Duffy |
| 3,858,262 | A | 1/1975 | Duffy |
| 3,894,509 | A | 7/1975 | Duffy et al. |
| 3,896,760 | A | 7/1975 | Duffy |
| RE28,812 | E | 5/1976 | Duffy |
| 3,995,074 | A | 11/1976 | Duffy et al. |
| 4,054,688 | A | 10/1977 | Duffy et al. |
| 4,060,868 | A | 12/1977 | Axvig et al. |
| 4,100,882 | A | 7/1978 | Duffy et al. |
| 4,120,993 | A | 10/1978 | Duffy et al. |
| 4,366,190 | A | 12/1982 | Rodden et al. |
| 4,775,555 | A | 10/1988 | Duffy |
| 4,815,414 | A | 3/1989 | Duffy et al. |
| 4,835,819 | A | 6/1989 | Duffy et al. |
| 4,842,890 | A | 6/1989 | Sessa et al. |
| 4,865,881 | A | 9/1989 | Sessa et al. |
| 4,888,214 | A | 12/1989 | Duffy et al. |
| 5,025,750 | A | 6/1991 | Sessa et al. |
| RE33,766 | E | 12/1991 | Duffy et al. |
| 5,078,083 | A | 1/1992 | DiMaio et al. |
| 5,090,355 | A | 2/1992 | DiMaio et al. |
| 5,141,375 | A | 8/1992 | Pollizzi |
| 5,141,771 | A | 8/1992 | DiMaio et al. |
| 5,169,621 | A | 12/1992 | DiMaio et al. |
| 5,221,170 | A | 6/1993 | Duffy et al. |
| 5,236,505 | A | 8/1993 | DiMaio et al. |
| 5,262,197 | A | 11/1993 | Pollizzi |
| 5,306,346 | A | 4/1994 | DiMaio et al. |
| 5,356,254 | A | 10/1994 | DiMaio et al. |
| 5,362,327 | A | 11/1994 | Sessa et al. |
| 5,403,624 | A | 4/1995 | DiMaio et al. |
| 5,511,510 | A | 4/1996 | Duffy et al. |
| 5,571,323 | A | 11/1996 | Duffy et al. |
| 5,611,652 | A | 3/1997 | Duffy et al. |
| 5,620,520 | A | 4/1997 | Duffy et al. |
| 5,620,741 | A | 4/1997 | Duffy et al. |
| 5,718,945 | A | 2/1998 | Arslanouk |
| 5,758,798 | A | 6/1998 | Duffy et al. |
| 5,792,512 | A | 8/1998 | Duffy et al. |
| 5,900,269 | A | 5/1999 | Duffy et al. |
| 5,908,155 | A | 6/1999 | Duffy et al. |
| 6,004,627 | A | 12/1999 | Duffy et al. |
| 6,017,391 | A | 1/2000 | Duffy et al. |

*Primary Examiner*—Richard Crispino
*Assistant Examiner*—Y. T. Tadesse
(74) *Attorney, Agent, or Firm*—Niro, Scavone, Haller & Niro

(57) ABSTRACT

An apparatus and method for applying a thermoplastic powder to threads located in a bore of an internally threaded fastener having a powder supply conduit in communication with a powder source and a powder application conduit defining a first passageway having a powder discharge port and a second passageway having a powder inlet port located adjacent the discharge port which is in communication with a powder collection system. The powder application conduit is movable for insertion into and through the bore of the fastener and into engagement with the powder supply conduit. The engagement forms a nozzle which directs powder through the powder discharge port onto the threads of the fastener and retrieves excess powder through the powder inlet port for conveyance to the powder collection system.

34 Claims, 2 Drawing Sheets

Fig. 2"

UNITARY SPRAY NOZZLE

BACKGROUND OF THE INVENTION

The present invention relates to an apparatus and method for applying a thermoplastic powder to the internal threads of a fastener and other objects. More specifically, the present invention concerns a unique and novel spray nozzle which fits within the bore of a fastener and which selectively coats predetermined threads on the fastener.

SUMMARY OF THE INVENTION

In the application of thermoplastic powders to fasteners to create what are commonly referred to as self-locking fasteners and the like, among other things, an important consideration is to precisely apply the powder material to predetermined threads or locations on the fastener. Often, it is necessary or important to have a sharply-defined and clean lead thread on each end of the fastener so as to facilitate installation of the fastener. However, in smaller diameter internal fasteners such as M8 or smaller, the small diameter of the fastener with attendant reduced thickness makes it difficult to precisely apply the material and maintain a sharply-defined locking element with known nozzle configurations. In addition, it is necessary to control excess powder sprayed from the nozzle in the reduced working environment to prevent excess powder from adhering to and blocking the spray nozzle.

The present invention solves the above stated problems by providing a unitary nozzle that combines a powder collection port in close proximity to a powder application port. This nozzle is comprised of two elongated and engageable conduits. The first conduit has a passageway which is in communication with a powder supply and an air source. The second conduit telescopically engages the first conduit and has two passageways. The first passageway terminates in a discharge port and combines with the passageway of the first conduit to form a complete powder spray path which directs powder on to the threads of the fastener. The second conduit also has a second passageway in communication with a powder collection system and an inlet port through which excess powder is retrieved. To selectively coat predetermined threads on a fastener, the second conduit is first inserted into the bore of the fastener and then engages the first conduit. The conduit then moves axially within the fastener bore to coat predetermined threads on the fastener. Alternately, the fastener may also be moved axially with respect to the spray nozzle.

While the invention is particularly useful in processing small diameter internal fasteners, it is useful for larger sizes as well. Thus, one object of the present invention is to provide an apparatus and method which may be used to selectively apply thermoplastic powder to small diameter internally threaded fasteners and other small objects.

Another object of the present invention is to provide an apparatus and method which applies thermoplastic powder to predetermined threads on a fastener.

Yet another object of the present invention is to provide a method and apparatus which produces a sharply-defined patch and clean lead threads on a fastener.

BRIEF DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
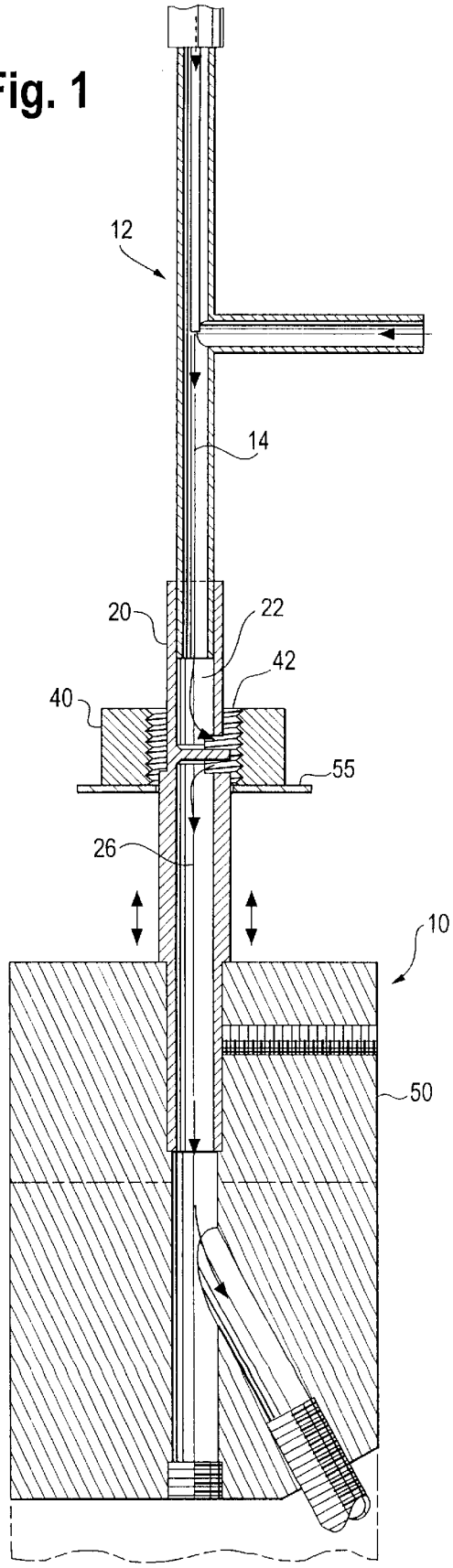
FIG. 1 is a cross-sectional view of one embodiment of the present invention.
Figure 2:
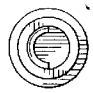
FIG. 2 is an exploded cross-sectional view of the nozzle shown in FIG. 1.
Figure 2:
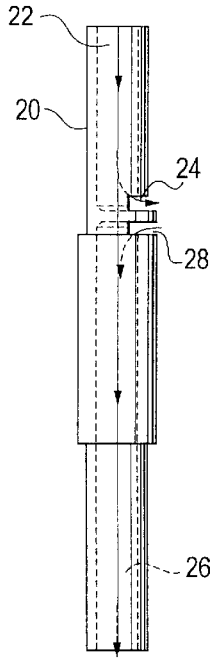
Figure 2:
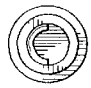

As shown in FIGS. 1 and 2, one embodiment of the present invention provides a thermoplastic spray apparatus 10 having a first or powder supply conduit 12 which may be T-shaped as shown and having a passageway 14 which is in communication with a powder supply (not shown). The conduit may be stainless steel tubing of the appropriate size.

Also provided with the, present invention is a second powder application conduit 20 having a first passageway 22 which terminates in a discharge port 24 as shown in FIG. 2. A second passageway 26 is also provided which is in communication with a powder collection system (not shown) that may be a vacuum source. Second passageway 26 terminates in an inlet port 28 which is adjacently located to discharge port 24.

Figure 3:
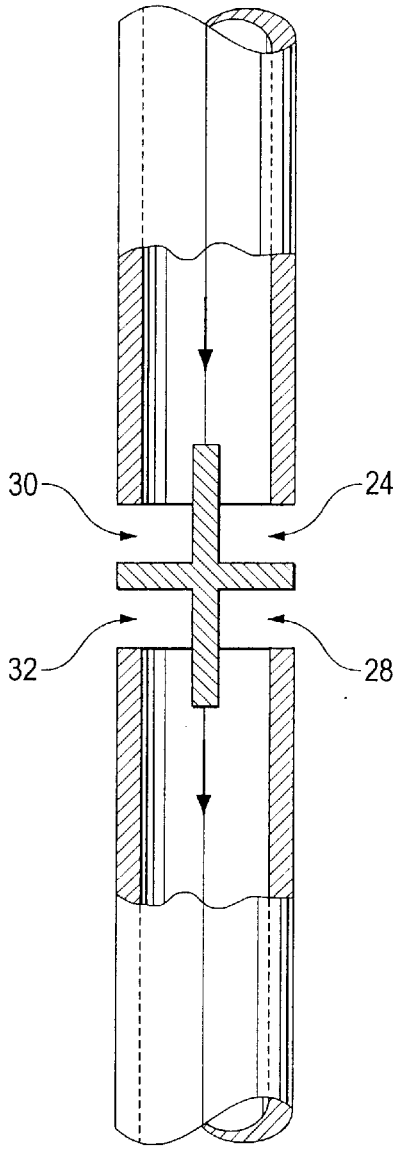
FIG. 3 is cross-sectional view of another embodiment of the present invention having a nozzle with opposingly located discharge and inlet ports.

Passageways, 22, and 26 may be formed by drilling a hole from each end in stock material such as brass in the range of ¼ to 5/16 inches in diameter to form conduit 20. Ports 24 and 28 may be formed by cutting slits or slots in the conduit that extend into the passageways. A flat bottom hole 22 provides more even flow of powder from slot 24. It has also been found that increasing the depth of the slit or slot, increases the radial application of powder spray. In addition, as shown in FIG. 3, an opposingly located discharge port 30 and inlet port 32 may also be used to increase the zone or area of radial coverage of the powder applied to the internal threads or surface.

The area of spray coverage may also be increased by increasing the axial height of the cut-out which forms the slot that forms ports 24 and 30. However, to selectively apply the material to predetermined threads 42 on fastener 40, it has been found that the height of ports 24 and 30 may be about a distance which is equal to or less than the pitch of the fastener.

Conduit 20 may be attached to block 50 which may be adapted to move axially to apply powder to predetermined fastener threads. Conduit 20 may also be adapted to move axially as well to apply powder to predetermined fastener threads. To facilitate production techniques, conduit 20 may be axially moveable from a retracted position which is remote from the fastener or object to an extended position where the conduit is inserted into and through the bore of fastener 40.

Figure 4:
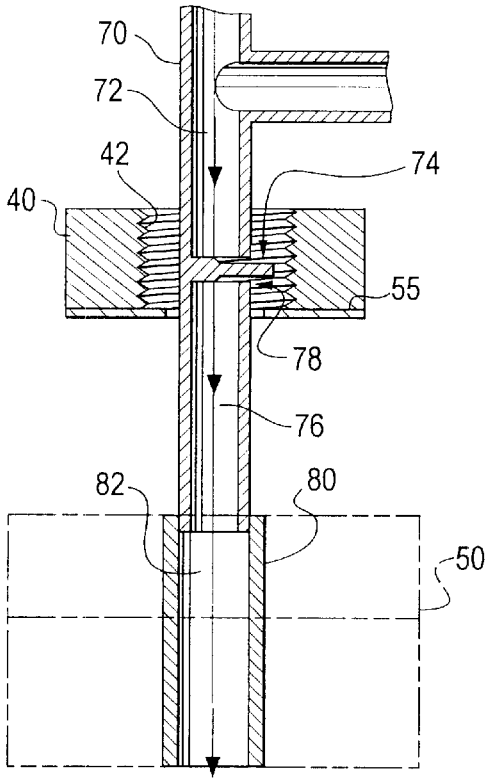
FIG. 4 is a cross-sectional view of another embodiment of the present invention.

As is further shown in FIG. 4, the structure and function of the conduits may be reversed. As shown, powder application conduit 70 may include a first passageway 72 which is in communication with a powder supply and an air source and which terminates in a discharge port 74. A second passageway 76 terminates in an inlet port 78. Also provided is a powder collection or retrieval conduit 80 having a passageway 82 which is in communication with a powder collection system which may be a vacuum source.

Figure 5:
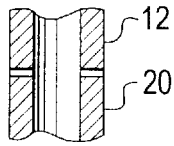
FIG. 5 is a partial cross-sectional view showing how the conduits axially abut together.

In operation, fastener 40 is conveyed by a linear or rotating conveyor to a fastener support 55 as is well known to those of skill in the art. Once fastener 40 is positioned above conduit 20, conduit 20 moves axially from a retracted position into and through fastener 40 until conduit 20 engages conduit 12 which remains stationary. In a preferred form, conduits 12 and 20 may be telescopically engaged with conduit 12 being sized to fit within conduit 20. Of course, conduit 20 may be sized to fit within conduit 12 as well. In addition, as shown in FIG. 5, the conduits may simply abut together.

The engagement of the conduits forms a unitary spray and vacuum nozzle. Thus, once the discharge port is properly positioned with respect to a predetermined thread, the system is activated and powder is discharged from discharge port 24. The nozzle may then move axially within the bore of fastener 40 to coat additional threads as desired or the fastener or nut may be moved axially through the actuation of support 55. Activating the spray apparatus when the discharge port is properly located with respect to predetermined threads permits selective application of the thermoplastic powder.

To prevent excess powder spray from adhering to the fastener and other locations, and to sharply define the lead threads and edges of the resulting patch, the powder collection system is continuously activated before, during and after the powder spray cycle. When activated, the close proximity of inlet port 28 and 32 which may be about 1/32 of an inch away from the discharge port allows the system to retrieve excess powder that is not collected on the threads.

To produce a clean lead thread, the collection system is continuously activated and the powder spray cycle is activated when the discharge port is properly positioned one thread away from the lead thread. Next, the conduit continues to move axially until all of the predetermined threads are coated. The spray cycle may also be continued as conduit 20 travels in the reverse direction towards the retracted and inactive position. Operating the spray cycle as the nozzle reciprocates within the bore of fastener 40 provides a uniform coating. To form opposingly located deposits, the nozzle shown in FIG. 3 may be used. It has also been found that galling has been reduced on stainless fasteners when deposits that are 180° apart are used.

The embodiment shown in FIG. 4 operates in a similar manner. Once fastener 40 is properly positioned, powder application conduit 70 axially moves into engagement with powder retrieval conduit 80 to form a unitary spray and vacuum nozzle. The spray cycle is activated when the discharge port is properly positioned in relation to threads 42 and the nozzle reciprocates axially to provide a uniform coating.

Alternately, once nozzle inserted through the bore of the fastener, the nozzle may remain stationary. To selectively apply powder in this embodiment, fastener 40 may be moved axially with respect to threads 42 by actuating fastener support 55 axially with respect to threads 42.

While the invention has been described with reference to the preferred embodiments thereof, it will be appreciated that numerous variations, modifications, and alternate embodiments are possible including the use of the apparatus with objects other than fasteners. Accordingly, all such variations, modifications, and alternate embodiments are to be regarded as being within the spirit and scope of the invention.

What is claimed is:

1. An apparatus for applying a thermoplastic powder to threads located in a bore of an internally threaded fastener comprising:

a powder supply conduit in communication with a powder source;

a powder application conduit defining a first passageway having a powder discharge port and a second passageway having a powder inlet port located adjacent said discharge port and in communication with a powder collection system;

said powder application conduit being movable for insertion into and through said bore of said fastener and into engagement with said powder supply conduit to form a nozzle which directs powder through said powder discharge port onto the threads of the fastener and retrieves excess powder through said powder inlet port for conveyance to the powder collection system.

2. The apparatus of claim 1 wherein said powder application conduit coaxially engages said powder supply conduit.

3. The apparatus of claim 1 wherein said powder application conduit and said powder supply conduit telescopically engage.

4. The apparatus of claim 1 wherein said powder supply conduit is stationary and said powder application conduit reciprocates axially between a retracted inactive position and an extended powder application position.

5. The apparatus of claim 1 wherein said discharge port moves axially within the bore of the fastener during the discharge of the powder to selectively coat predetermined threads on the fastener.

6. The apparatus of claim 1 wherein said powder application conduit further includes an opposingly located second discharge port and opposingly located second inlet port.

7. A spray and vacuum nozzle for applying a thermoplastic powder to threads located in a bore of an internally threaded fastener and collecting excess powder material through a vacuum source comprising:

a powder supply conduit defining a passageway through which powder flows;

a powder application conduit defining a first passageway having a discharge port and a second passageway having an inlet port located adjacent said discharge port in communication with a vacuum source; and said powder supply and powder application conduits align coaxially to form a unitary spray and vacuum nozzle through which powder is discharged through said discharge port and excess powder is collected through said inlet port by the vacuum source.

8. The apparatus of claim 7 wherein said powder application conduit further includes an opposingly located second discharge port and an opposingly located second inlet port.

9. An apparatus for applying a powder coating to threads located in a bore of an internally threaded fastener comprising:

a powder supply conduit defining a passageway in communication with a powder source;

a powder application conduit defining a first passageway having a powder discharge port and a second passageway having a powder inlet port located adjacent said discharge port and in communication with a powder collection system;

said powder application conduit positionable between an inactive retracted position wherein said conduit is remote from the fastener and an extended position wherein said conduit extends into and through the bore of the fastener and engages said powder supply conduit to form a spray and vacuum nozzle in which powder is discharged through said powder discharge port onto the threads of the fastener and excess powder is retrieved by the powder collection system through said powder inlet port for conveyance to the powder collection system.

10. The apparatus of claim 9 wherein said discharge port moves axially within the bore of the fastener during the discharge of the powder to selectively coat predetermined threads on the fastener.

11. The apparatus of claim 9 wherein said powder application conduit further includes an opposingly located second discharge port and opposingly located second inlet port.

12. The apparatus of claim 9 wherein said powder supply conduit and said powder application conduit telescopically engage.

13. An apparatus for applying a thermoplastic powder to threads located in a bore of an internally threaded fastener comprising:

a powder collection conduit in communication with a powder collection system;

a powder application conduit defining a first passageway having a powder discharge port and a second passageway having a powder inlet port located adjacent said discharge port and in communication with a powder collection system;

said powder application conduit being movable for insertion into and through said bore of said fastener and into engagement with said powder collection conduit to form a nozzle which directs powder through said powder discharge port onto the threads of the fastener and retrieves excess powder through said powder inlet port for conveyance to the powder collection system.

14. The apparatus of claim 13 wherein said powder application conduct coaxially engages said powder collection conduit.

15. The apparatus of claim 13 wherein said powder application conduit and said powder collection conduit telescopically engage.

16. The apparatus of claim 13 wherein said powder collection conduit is stationary and said powder application conduit reciprocates axially between a retracted inactive position and an extended powder application position.

17. The apparatus of claim 13 wherein said discharge port moves axially within the bore of the fastener during the discharge of the powder to selectively coat predetermined threads on the fastener.

18. The apparatus of claim 13 wherein said powder application conduit further includes an opposingly located second discharge port and opposingly located second inlet port.

19. A spray and vacuum nozzle for applying a thermoplastic powder to threads located in a bore of an internally threaded fastener and collecting excess powder material through a vacuum source comprising:

a stationary powder collection conduit defining a passageway which is in communication with a powder collection system;

a powder application conduit defining a first passageway having a discharge port and a second passageway having an inlet port located adjacent said discharge port; and said powder application conduit moves axially to engage said powder collection conduit to form a unitary spray and vacuum nozzle through which powder is discharged through said discharge port and excess powder is collected through said inlet port by the vacuum source.

20. The apparatus of claim 19 wherein said powder collection and powder application conduits align coaxially.

21. The apparatus of claim 19 wherein said powder collection conduit and said powder application conduit telescopically engage.

22. An apparatus for applying a powder coating to threads located in a bore of an internally threaded fastener comprising:

a powder collection conduit defining a passageway in communication with a powder collection system;

a powder application conduit defining a first passageway having a powder discharge port and a second passageway having a powder inlet port located adjacent said discharge port;

said powder application conduit positionable between an inactive retracted position wherein said conduit is remote from the fastener and an extended position wherein said conduit extends into and through the bore of the fastener and engages said powder collection conduit to form a spray and vacuum nozzle in which powder is discharged through said powder discharge port onto the threads of the fastener and excess powder is retrieved by the powder collection system through said powder inlet port for conveyance to the powder collection system.

23. The apparatus of claim 22 wherein said discharge port moves axially within the bore of the fastener during the discharge of the powder to selectively coat predetermined threads on the fastener.

24. The apparatus of claim 22 wherein said powder application conduit further includes an opposingly located second discharge port and opposingly located second inlet port.

25. The apparatus of claim 22 wherein said powder collection conduit and said powder application conduit telescopically engage.

26. The device of claim 1 wherein said fastener moves axially with respect to said nozzle to selectively coat predetermined threads on said fastener.

27. The device of claim 7 wherein said fastener moves axially with respect to said nozzle to selectively coat predetermined threads on said fastener.

28. The device of claim 9 wherein said fastener moves axially with respect to said nozzle to selectively coat predetermined threads on said fastener.

29. The device of claim 13 wherein said fastener moves axially with respect to said nozzle to selectively coat predetermined threads on said fastener.

30. The device of claim 19 wherein said fastener moves axially with respect to said nozzle to selectively coat predetermined threads on said fastener.

31. The device of claim 22 wherein said fastener moves axially with respect to said nozzle to selectively coat predetermined threads on said fastener.

32. A spray and vacuum nozzle for applying a thermoplastic powder to threads located in a bore of an internally threaded fastener and collecting excess powder material through a vacuum source comprising:

a stationary powder supply conduit defining a passageway through which powder flows;

a powder application conduit defining a first passageway having a discharge port and a second passageway having an inlet port located adjacent said discharge port in communication with a vacuum source; and said powder application conduit moves axially to engage said powder supply conduit to form a unitary spray and vacuum nozzle through which powder is discharged through said discharge port and excess powder is collected through said inlet port by the vacuum source.

33. A spray and vacuum nozzle for applying a thermoplastic powder to threads located in a bore of an internally threaded fastener and collecting excess powder material through a vacuum source comprising:

a powder supply conduit defining a passageway through which powder flows;

a powder application conduit defining a first passageway having a discharge port and a second passageway having an inlet port located adjacent said discharge port in communication with a vacuum source; and said powder supply and powder application conduits telescopically engage to form a unitary spray and vacuum nozzle through which powder is discharged through said discharge port and excess powder is collected through said inlet port by the vacuum source.

34. A spray and vacuum nozzle for applying a thermoplastic powder to threads located in a bore of an internally threaded fastener and collecting excess powder material through a vacuum source comprising:

a powder collection conduit defining a passageway which is in communication with a powder collection system;

a powder application conduit defining a first passageway having opposingly located discharge ports and a second passageway having opposingly located inlet ports located adjacent said discharge ports; and said powder collection and powder application conduits align to form a unitary spray and vacuum nozzle through which powder is discharged through said discharge ports and excess powder is collected through said inlet ports by the vacuum source.

* * * * *